US006575385B1

(12) United States Patent
Stier

(10) Patent No.: US 6,575,385 B1
(45) Date of Patent: Jun. 10, 2003

(54) FUEL INJECTION VALVE

(75) Inventor: Hubert Stier, Aspert (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/701,773

(22) PCT Filed: Feb. 22, 2000

(86) PCT No.: PCT/DE00/00495

§ 371 (c)(1),
(2), (4) Date: Mar. 28, 2001

(87) PCT Pub. No.: WO00/60232

PCT Pub. Date: Oct. 12, 2000

(30) Foreign Application Priority Data

Apr. 3, 1999 (DE) ..... 199 15 210

(51) Int. Cl.[7] ..... B05B 1/08

(52) U.S. Cl. ..... 239/102.2; 239/239; 239/533.9; 239/533.11; 239/585.5

(58) Field of Search ..... 239/102.2, 533.1–533.12, 239/585.1, 585.5

(56) References Cited

U.S. PATENT DOCUMENTS 4,101,076 A * 7/1978 Bart ..... 239/584
5,625,946 A * 5/1997 Wildeson et al. ..... 239/585.4
5,996,912 A * 12/1999 Ren et al. ..... 239/585.5

* cited by examiner

*Primary Examiner*—Michael Mar
*Assistant Examiner*—Dinh Q. Nguyen
(74) *Attorney, Agent, or Firm*—Kenyon & Kenyon

(57) ABSTRACT

A fuel injector for a fuel injection system of an internal combustion engine includes an energizable actuator having a valve closure element actuable by the actuator by a valve needle, which coacts with a valve seating surface to form a sealing fit and which is held in the closed position by a return spring. The actuator acts on the valve needle via a sleeve-shaped needle driver that is separate from the valve needle, which is arranged in an axially movable fashion with respect to the needle driver, and a collar of the needle driver is engageable behind a needle collar of the valve needle at the end facing away from the return spring.

20 Claims, 5 Drawing Sheets

FUEL INJECTION VALVE

FIELD OF THE INVENTION

The present invention relates to a fuel injector.

BACKGROUND INFORMATION

A fuel injector is discussed in German Published Patent Application No. 195 34 445. The fuel injector includes a valve housing, configured in two parts, in which a valve needle is guided in axially movable fashion. The valve housing has at one end a fuel connector through which fuel is conveyed to the fuel injector. At the other end, the valve needle coacts with the valve housing to constitute a sealing fit, the valve needle being held in the closed position by way of a return spring. To actuate the valve needle, the latter is equipped at the inflow end with a pressure shoulder which coacts with a piezoelectric actuator and is immovably joined to the valve needle. Upon actuation of the valve needle, the actuator acts against the force of the return spring.

Some disadvantages that may be associated with the above fuel injector are as follows:

Since the valve needle is immovably joined to the pressure shoulder, and the valve needle is guided at the spray discharge end, and the pressure shoulder at the inflow end, movably in the valve body, a large inert mass, made up of the mass of the valve needle and the mass of the pressure shoulder, must be actuated in order for the fuel injector to be opened and closed by the actuator and the return spring, respectively. In addition, the two guides provided for axially movable guidance of the valve needle—for the valve needle in the spray-discharge end and on the pressure shoulder at the inflow end—must be matched to one another, the result being that production of the fuel injector is relatively complex, and the fuel injector is susceptible to warping or distortion of the valve needle and/or the valve housing.

Since the return spring also returns the actuator in order to close the fuel injector, the closing motion of the valve needle is not decoupled from the closing motion of the actuator.

As a result of the large mass (made up of the mass of the valve needle and the mass of the pressure shoulder) to be actuated by the return spring, bouncing and therefore unintentional additional spray discharge of fuel occur upon closure of the fuel injector. Another result of this is increased wear on the fuel injector, and thus a shorter service life.

In addition, the fact that guidance of the valve needle is rigid and permanently defined means that the position of the valve needle in the sealing fit is permanently defined, the result being that the valve needle cannot center itself on a sealing fit that deviates from the ideal position as a result of production factors or wear. This results in inhomogeneous and increased wear on the valve needle in the region of the sealing fit, in particular in a degradation in the sealing of the sealing fit of the fuel injector in the closed position, and a change in the geometry of the discharged stream of fuel.

SUMMARY OF THE INVENTION

The fuel injector according to an exemplary embodiment of the present invention is believed to have the advantages that it yields a low-wear, reduced-friction design. The fuel injector is moreover almost bounce-free, so that upon actuation of the fuel injector, the duration of the spray discharge operation and the quantity of fuel discharged can be specified in defined fashion.

In an exemplary embodiment, the valve needle is guided in axially movable fashion by a valve needle guide at only one point. In particularly advantageous fashion, the valve needle is small and has low mass.

In an exemplary embodiment, the valve needle rests at one of its end faces against a swirl disk. As a result, the valve needle is guided coaxially with respect to the axis of the fuel injector, thus resulting in homogeneous energy transfer by the valve needle onto the sealing fit, and homogeneous wear in the region of the sealing fit.

In an exemplary embodiment, the valve needle guide and/or the swirl disk have orifices for the passage of fuel. This yields a simple physical design for passage of the fuel.

In an exemplary embodiment, a gap that widens in the radial direction toward the valve axis is formed between the needle collar of the valve needle and the collar of the needle driver. A liquid cushion formed between the collar of the needle driver and the needle collar can thereby be quickly displaced, the result being that the liquid cushion has no influence on switching time and that, in particular, shorter switching times are made possible.

In an exemplary embodiment, the needle driver has at least one orifice or bore for the passage of fuel. The interior of the needle driver can thereby serve as a fuel conduit, the fuel being directed out of the interior of the needle driver through the orifice toward the sealing fit.

In an exemplary embodiment, the orifice is formed by at least one slit in the needle driver extending in the axial direction. The shape of the orifice is thereby adapted to the flow direction of the fuel.

In an exemplary embodiment, the needle driver has an opening with radial enlargements at its end toward the needle collar, which overlap the adjacent end surface of the needle collar to form flow-through windows. The fuel can be passed through the flow-through windows that are created.

Alternatively, the needle driver has a circular opening at its end toward the needle collar, and the end surface of the needle collar is of polygonal configuration, so that the end surface of the needle collar is partially overlapped by the opening of the needle driver to form flow-through openings. As a result, no further design changes to the needle driver are necessary, and flow-through openings that are arranged in a manner favorable to flow are created. In addition, any liquid cushion formed between the collar of the needle driver and the needle collar can be rapidly displaced, the result being that the liquid cushion has no influence on switching times and, in particular, that shorter switching times are made possible.

In an exemplary embodiment, the return spring is braced, at the end facing away from the needle collar, against an adjusting element, the adjusting element being joined to the needle driver. As a result, on the one hand the return spring can be preloaded in a defined manner that is simple in terms of production engineering. On the other hand, the return spring defines only the closing force of the fuel injector when the fuel injector is closed. The forces required to open and close the fuel injector can then be defined by the actuator and by at least one further spring.

DETAILED DESCRIPTION

Figure 1:
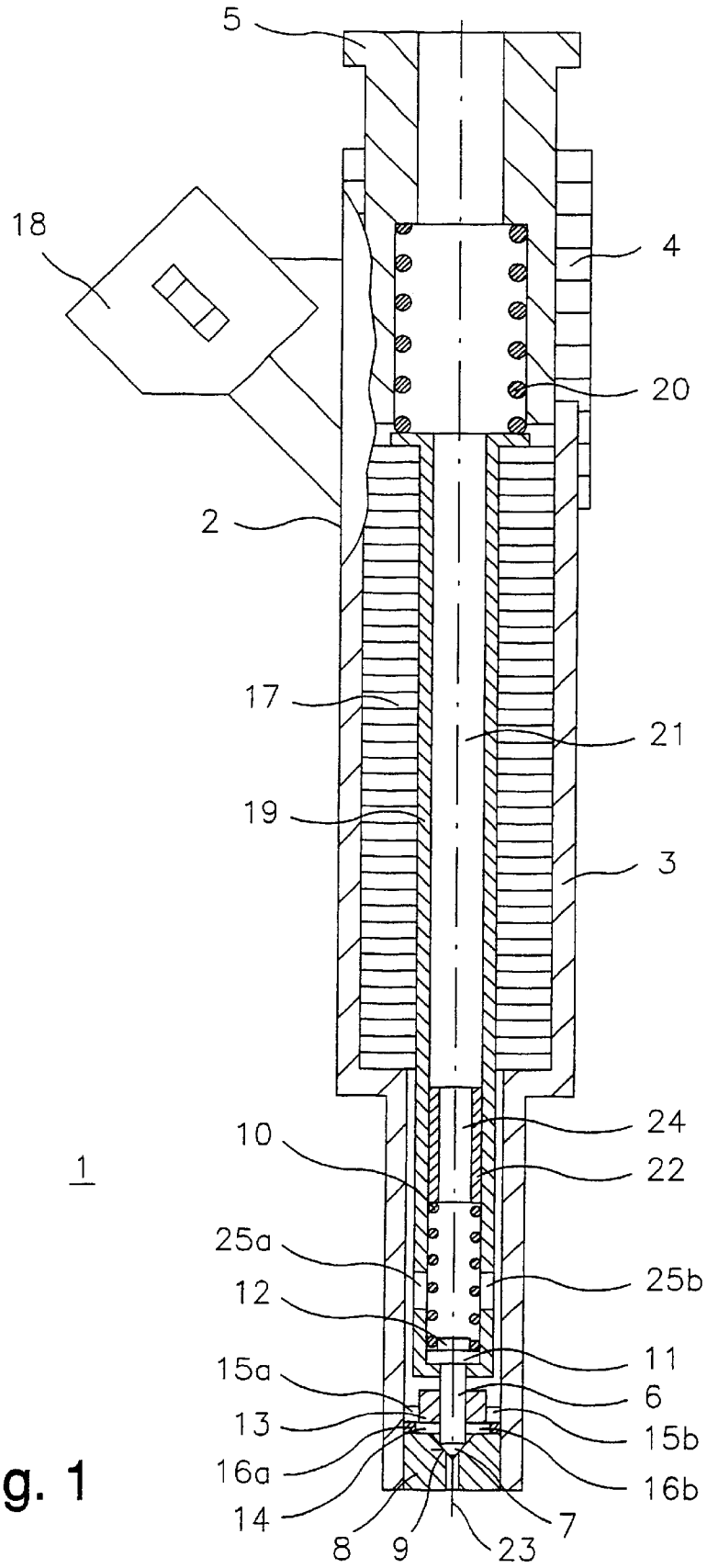
FIG. 1 shows a partial axial section through an exemplary embodiment of a fuel injector according to the present invention.

FIG. 1 shows, in a partial axial sectioned depiction, a fuel injector 1 according to an exemplary embodiment of the present invention. Fuel injector 1 is embodied here as an inward-opening fuel injector 1. Fuel injector 1 is used in particular for direct injection of fuel, in particular gasoline, into a combustion chamber of a mixture-compressing, spark-ignited internal combustion engine, as a so-called direct gasoline injector. Fuel injector 1 according to an exemplary embodiment of the present invention is also suitable for other applications, however.

Fuel injector 1 has a valve housing 2 that is made up of a front valve housing 3, a rear valve housing 4, and a fuel connector 5. Located in front valve housing 3 is a valve closure element 7, actuable by way of a valve needle 6, that in the exemplary embodiment depicted is configured integrally with valve needle 6. Valve closure element 7 is configured with a truncated conical shape tapering in the spray discharge direction, and coacts with a valve seat surface 9 configured on a valve seat element 8 to constitute a sealing fit. In this context, valve needle 6 is held in the closed position by way of a return spring 10 that acts on valve needle 6 via a valve needle collar 11 of valve needle 6. Return spring 10 is centered at its end toward needle collar 11 by way of a centering element 12. In the exemplary embodiment depicted, valve needle 6, needle collar 11, and centering element 12 are integrally configured. The very small and low-mass (0.1–0.5 g) valve needle 6 is guided in its axial movement by a single valve needle guide 13. Valve needle guide 13 rests at its spray-discharge end face against a swirl disk 14. Swirl disk 14 is mounted in the front portion of valve housing 3 and rests, at its end face opposite valve needle guide 13, against valve seat element 8. In order to allow fuel to flow through, valve needle guide 13 and swirl disk 14 have orifices 15*a*, 15*b*, 16*a*, 16*b*, orifices 16*a*, 16*b* in swirl disk 14 being configured as swirl channels.

Figure 10:
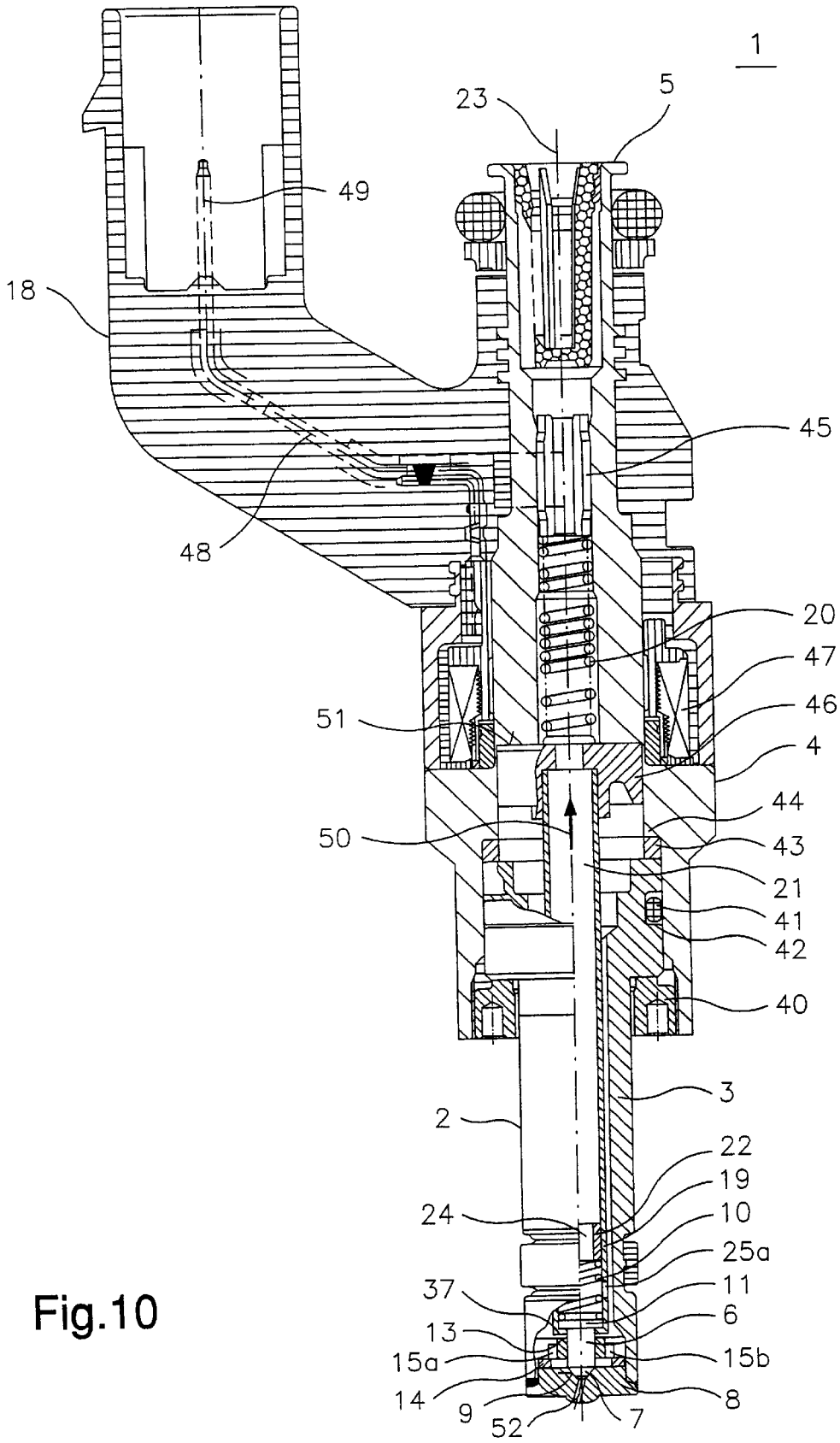
FIG. 10 shows a partial axial section through another exemplary embodiment of a fuel injector according to the present invention.

Actuation of fuel injector 1 is effected by an actuator 17 that is embodied in piezoelectric, magnetostrictive, or electromagnetic fashion (FIG. 10). Actuation of actuator 17 is accomplished via an electrical control signal that is transferred via an electrical connector 18 and an electrical lead (not depicted) to actuator 17. When actuator 17 is actuated, it expands and moves a needle driver 19, which is of tubular configuration and passes through actuator 17 in an internal longitudinal opening, toward fuel connector 5 against the force of a preload spring 20. Needle driver 19 engages behind needle collar 11, and upon actuation of actuator 17 acts upon valve needle 6, thereby moving valve needle 6 in the direction of fuel connector 5. As a result, valve closure element 7 lifts off from valve seat surface 9 of valve seat element 8, and disengages the sealing fit. The resulting gap between valve closure element 7 and valve seat surface 9 of valve seat element 8 allows fuel to emerge from fuel injector 1 into the combustion chamber of the internal combustion engine.

Needle driver 19 is returned by way of preload spring 20, which is braced at fuel connector 5 against needle driver 19; preload spring 20 also brings about the return of actuator 17. Needle driver 19 has an internal orifice 21 in which a sleeve-shaped adjusting element 22 is located. Return spring 10 is braced against adjusting element 22 at the end located opposite needle collar 11. By displacing adjusting element 22 in internal orifice 21 of needle driver 19, it is easy to apply a defined preload to return spring 10. The return stroke of valve needle 6 is accomplished by return spring 10.

Fuel is guided from fuel connector 5 through internal orifice 21 of needle driver 19 and an internal orifice 24 of adjusting element 22 toward needle collar 11 on valve needle 6. In order to allow fuel to flow toward the sealing fit, flow-through openings are configured in needle driver 19. In the exemplary embodiment depicted, the flow-through openings are created by two bores 25*a*, 25*b* extending transversely in needle driver 19. This and other fuel passage embodiments are discussed in the description below.

Figure 2:
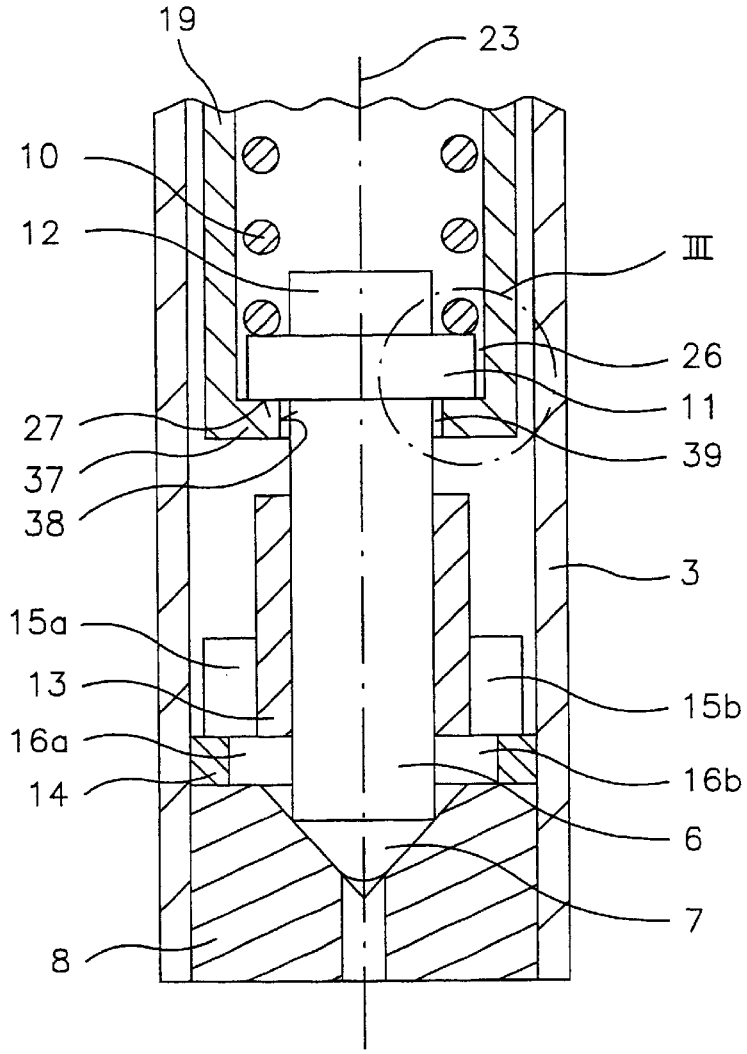
FIG. 2 shows a partial axial section through the discharge-end region of an exemplary embodiment of a fuel injector according to the present invention.

FIG. 2 depicts, in a partial axial sectioned depiction, a detail of the spray-discharge end of fuel injector 1. Elements already described are labeled with matching reference characters, and any repeat description of them will be dispensed with.

In contrast to FIG. 1, valve closure element 7 is of partially spherical configuration. This configuration is believed to be particularly advantageous in the context of the self-guidance of valve needle 6 and valve closure element 7 discussed in the description of FIG. 1. A central opening 38, which has a greater diameter than valve needle 6 and through which the latter passes, is provided in a bottom portion 37 of needle driver 19 that engages beneath needle collar 11 and represents a collar. A circular annular gap 39 is thus formed between needle driver 19 and valve needle 6. In addition, the outside diameter of needle collar 11 is smaller than the inside diameter of needle driver 19, so that an annular gap 26 is formed between needle collar 11 and needle driver 19. Needle driver 19 acts with its bottom portion 37 on a stop surface 27 of needle collar 11.

If, following actuation of fuel injector 1, needle driver 19 is returned faster than valve needle 6, a liquid cushion forms beneath stop surface 27 between bottom portion 37 of needle driver 19 and needle collar 11. In order to close fuel injector 1 completely, return spring 10 must displace the liquid cushion beneath stop surface 27. In order to displace the liquid cushion as quickly as possible, the needle collar is advantageously modified. One possible embodiment is described in detail in FIG. 3.

Figure 3:
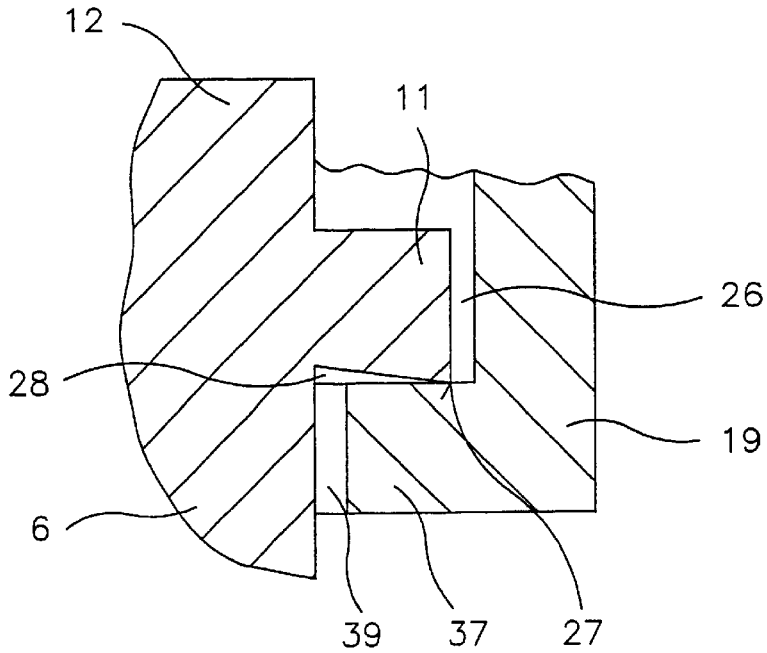
FIG. 3 shows the portion labeled III of FIG. 2.

FIG. 3 shows the detail labeled III in FIG. 2, presenting an advantageous development of needle collar 11. In order to allow valve needle 6 to move radially, annular gaps 26, 39 already described between are configured between valve needle 6 and needle collar 11, respectively, and needle driver 19. In this context, valve needle 6, needle collar 11, and centering element 12 are configured integrally. A gap 28, which widens in the radial direction toward valve axis 23, is configured between needle collar 11, valve needle 6, and bottom portion 37 of needle driver 19. In the sectioned drawing, gap 28 therefore has a wedge-shaped configuration. Stop surface 27 is therefore reduced to a narrow annular surface. Because of the particular configuration of needle collar 11, the liquid cushion between needle collar 11 and bottom portion 37 of needle driver 19 can be rapidly displaced, with the result that valve needle 6 is returned more rapidly to its starting position. Gap 28 can also be embodied by way of a particular configuration of bottom portion 37 of needle driver 19. In an exemplary embodiment that is not depicted, stop surface 27 can also be inclined in the opposite fashion, so that gap 28 becomes smaller toward valve axis 23.

Figure 4:
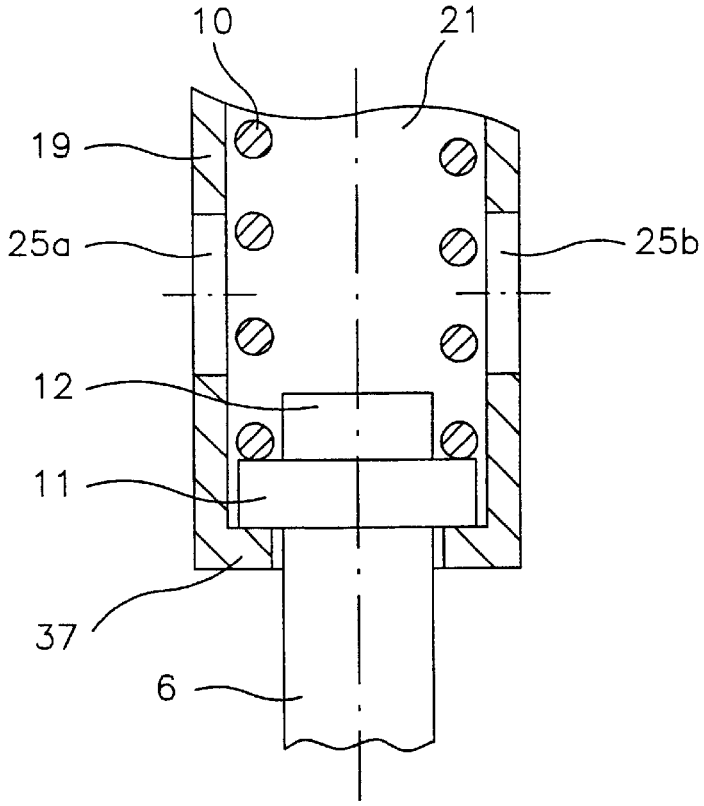
FIG. 4 shows a partial axial section through a portion of the fuel injector, two bore-like flow-through openings being provided in the needle driver.

FIG. 4 shows, in a partial axial sectioned depiction, a detail of fuel injector 1 according to the present invention. Elements already described are given matching reference characters, thereby rendering any repeat description superfluous. In the exemplary embodiment depicted, needle driver 19 has lateral bores 25*a*, 25*b* which allow fuel to flow from internal orifice 21 through bores 25*a*, 25*b* toward the sealing fit.

Figure 5:
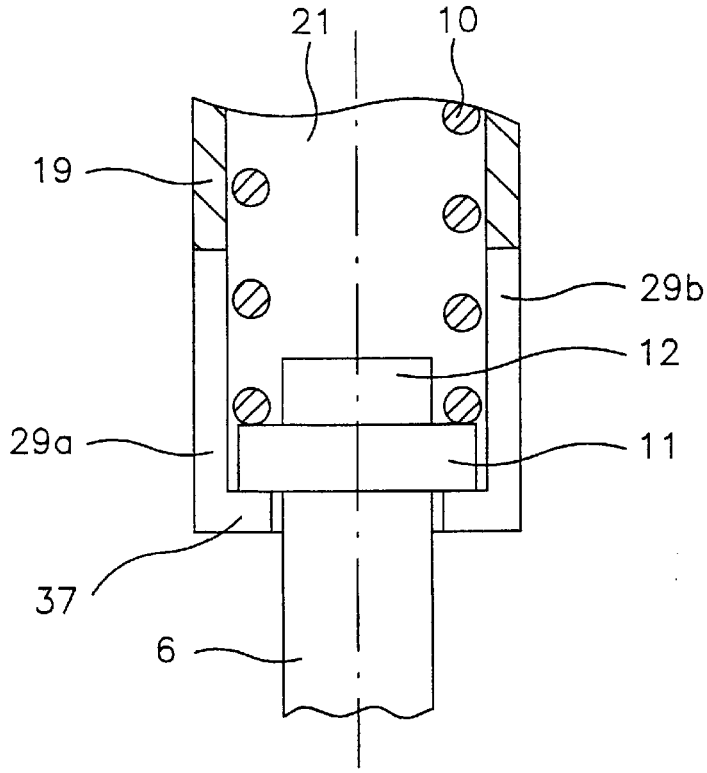
FIG. 5 shows a partial axial section through an exemplary embodiment of a fuel injector according to the present invention, slits allowing the passage of fuel being provided between the needle collar of the valve needle and the collar of the needle driver.

FIG. 5 shows, in a partial axial sectioned depiction, a detail of fuel injector 1 according to an exemplary embodiment of the present invention. Elements already described are given matching reference characters, thereby rendering any repeat description superfluous. In the exemplary embodiment depicted, needle driver 19 has slits 29*a*, 29*b* extending in the axial direction, through which fuel can flow out of internal orifice 21 of needle driver 19 toward the sealing fit. More than two slits 29*a*, 29*b* can also be provided, in order to make possible a greater flow of fuel.

Figure 6:
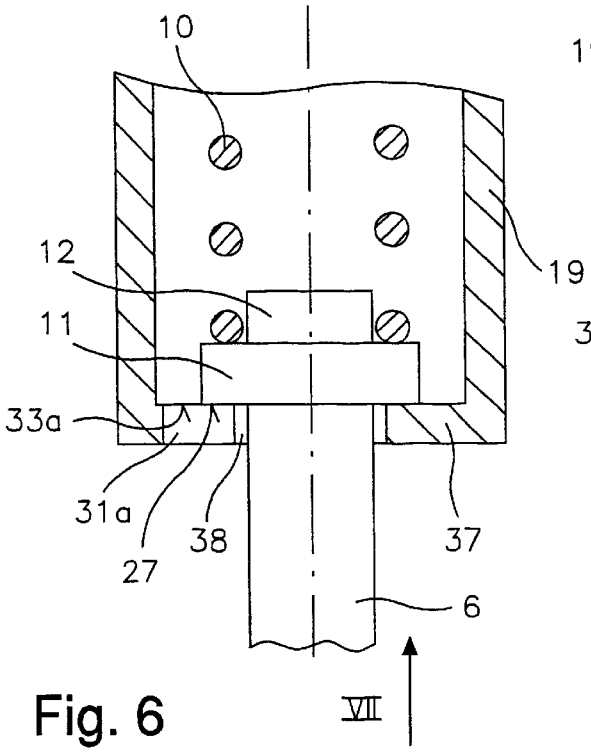
FIG. 6 shows a partial axial section through an exemplary embodiment of a fuel injector according to the present invention, orifices with radial enlargements being provided in the needle driver.

FIG. 6 shows, in a partial axial sectioned depiction, a detail of fuel injector 1 according to an exemplary embodiment of the present invention. Elements already described are given matching reference characters, thereby rendering any repeat description superfluous. In the exemplary embodiment depicted, opening 38 in bottom portion 37 of needle driver 19 is embodied with radial enlargements 31*a*–31*c*, only radial enlargement 31*a* being visible in this depiction. Radial enlargement 31*a* overlaps the adjacent lower stop surface 27 of needle collar 11 to form a flow-through window 33*a*.

Figure 7:
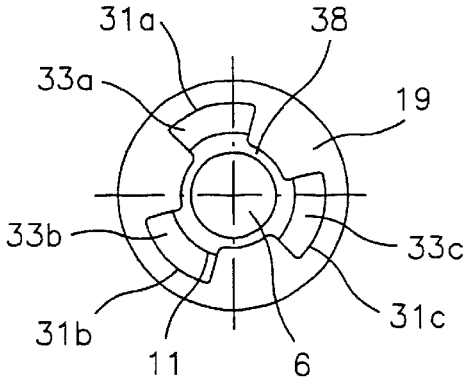
FIG. 7 shows a frontal view of the exemplary embodiment of FIG. 6, in the direction labeled VII.

FIG. 7 shows a front view, labeled VII in FIG. 6, of the detail of fuel injector 1 according to an exemplary embodiment of the present invention. Needle collar 11 of valve needle 6 is located in the interior of needle driver 19. Needle driver 19 has opening 38 with radial enlargements 31*a* through 31*c*. Enlargements 31*a* through 31*c* of opening 38 overlap needle collar 11 of valve needle 6, so that flow-through windows 33*a* through 33*c* are created. As a result of flow-through windows 33*a* through 33*c* (arranged, for example at a spacing of 120° from one another), fuel flows out of the interior of needle driver 19 toward the sealing fit of fuel injector 1.

Figure 8:
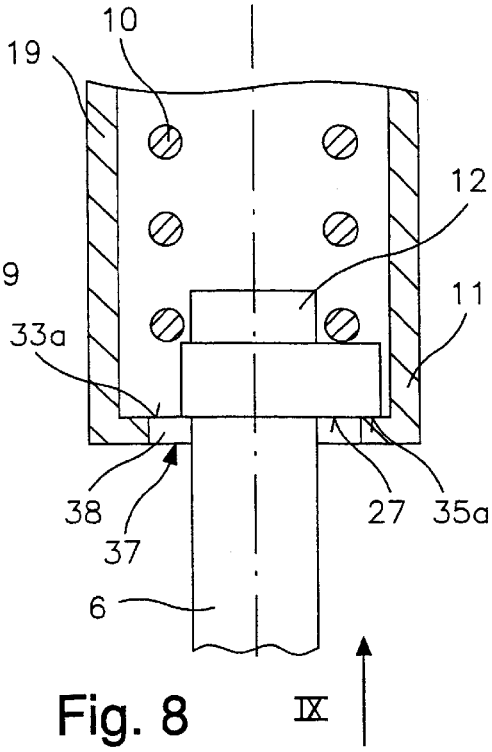
FIG. 8 shows a partial axial section through an exemplary embodiment of the fuel injector according to the present invention, in which the needle collar is triangular in shape.

FIG. 8 shows, in a partial axial sectioned depiction, a detail of fuel injector 1 according to an exemplary embodiment of the present invention. Elements already described are given matching reference characters. In this exemplary embodiment, bottom portion 37 of needle driver 19 has a circular opening 38 that is characterized by a comparatively large inside diameter. Needle collar 11 is triangular in shape, and is supported in the region of its stop surface 27 with contact surfaces 35*a* through 35*c*, only contact surface 35*a* being visible in this depiction. Circular opening 38 of needle driver 19 overlaps stop surface 27 of needle collar 11 to form flow-through window 33*a* on the side exactly opposite contact surface 35*a*.

Figure 9:
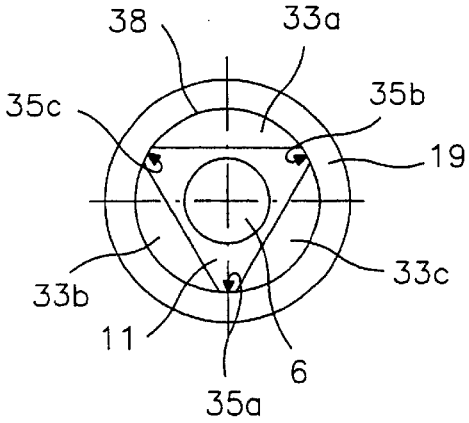
FIG. 9 shows a frontal view of the exemplary embodiment of FIG. 8, in the direction labeled IX.

FIG. 9 shows a front view, labeled IX in FIG. 8, of the detail of fuel injector 1. Needle driver 19 has a circular opening 38 at its end toward the needle collar, which partially overlaps needle collar 11, configured in triangular fashion, of valve needle 6 to form flow-through windows 33*a* through 33*c*. Needle driver 19 acts via contact surfaces 35*a* through 35*c* on needle collar 11 of valve needle 6. The fact that the total contact area resulting from contact surfaces 35*a* through 35*c* is relatively small results in the advantage that the liquid cushion, explained in the description of FIGS. 2 and 3, between needle driver 19 and needle collar 11 beneath contact surfaces 35*a* through 35*c* can be quickly displaced by return spring 10, with the result that the liquid cushion has little influence on the switching time of fuel injector 1.

FIG. 10 shows, in a partial axial sectioned depiction, a further exemplary embodiment of a fuel injector 1 according to the present invention. Elements already described are given matching reference characters, thereby rendering any repeat description superfluous.

In the exemplary embodiment depicted, front valve housing 3 is mounted onto rear valve housing 4 by way of a threaded joint 40. Sealing of this join is provided by a sealing ring 41 that is placed in a circumferential groove 42 of front valve housing 3. A stroke adjustment disk 43 is provided between an internal projection 44 of rear valve housing 4 and front valve housing 3 in order to adjust a stroke of valve needle 6. In the exemplary embodiment depicted, preload spring 20 is braced against an adjusting element 45; the preload of preload spring 20 can be adjusted by way of the axial position of adjusting element 45. Preload spring 20 acts on a magnet armature 46, thus causing needle driver 19 to be impinged upon by a preload force in the direction of the sealing fit. As described with reference to FIG. 1, valve closure element 7 of valve needle 6 is thereby pressed into valve seating surface 9 of valve seat element 8, thereby forming a sealing fit. Guidance of valve needle 6 is accomplished in this context by valve needle guide 13. A swirl disk 14 is arranged downstream from valve needle guide 13.

In this exemplary embodiment, actuation of fuel injector 1 is provided by an electromagnetically actuable actuator 46, 47, which includes a magnet coil 47 and magnet armature 46. Actuator 46, 47 is actuated by an electrical control signal that is guided via an electrical supply lead 48 to magnet coil 47 and is connected, in connector 18 of fuel injector 1, to a contact 49.

Upon actuation of magnet coil 47, magnet armature 46 is moved in opening direction 50 as far as a stop that is defined by a stop surface 51. Needle driver 19 is immovably joined to magnet armature 46, so that the latter also moves in opening direction 50. Since needle driver 19 engages behind needle collar 11 of valve needle 6 with its collar-shaped bottom portion 37, this motion causes valve needle 6 to be moved in opening direction 50; as a result, valve closure element 7 of valve needle 6 lifts off from valve seating surface 9 of valve sealing element 8, and the sealing fit is disengaged. As a result of the gap created between valve closure element 7 and valve seating surface 9, fuel emerges into spray discharge channel 52 of valve seat element 8, so that fuel is sprayed out of fuel injector 1 into the combustion chamber of the internal combustion engine.

After magnet coil 47 is deactivated, magnet armature 46 is moved by preload spring 20 opposite to opening direction 50, as a result of which needle driver 19 is returned in the direction of the sealing fit. As described with reference to FIG. 1, valve needle 6 is impinged upon, by way of return spring 10, by a return force in the direction of valve seat element 8, so that the sealing fit formed by valve closure element 7 and valve seating surface 9 closes.

The exemplary embodiments described in FIGS. 2 through 9 can be transferred without limitation to fuel injector 1 described in FIG. 10.

Present invention are not limited to the exemplary embodiments described. In particular, fuel injector 1 can also be embodied as an outward-opening fuel injector 1. In addition, needle driver 19 need not be configured in the interior of actuator 17, and return spring 10 need not be arranged in internal orifice 21 of needle driver 19.

What is claimed is:

1. A fuel injector for a fuel injection system of an internal combustion engine, the fuel injector comprising:

an energizable actuator;

a valve needle having a needle collar;

a valve seating surface;

a return spring;

a valve closure element, the valve closure element being actuable by the energizable actuator via the valve needle and being cooperable with the valve seating surface to form a sealing fit, the valve closure element being holdable in a closed position by the return spring; and a sleeve-shaped needle driver, the sleeve-shaped needle driver being separate from the valve needle and having a collar, wherein the valve needle is arranged to move axially with respect to the sleeve-shaped needle driver;

wherein the energizable actuator acts on the valve needle via the sleeve-shaped needle driver, the collar of the sleeve-shaped needle driver is engageable behind the needle collar of the valve needle at an end facing away from the return spring, and the sleeve-shaped needle driver passes through the energizable actuator in an internal longitudinal opening.

2. The fuel injector of claim 1, wherein the energizable actuator is one of a piezoelectric actuator, a magnetostrictive actuator and an electromagnetic actuator.

3. The fuel injector of claim 1, further comprising a single valve needle guide, wherein the valve needle is guided by being axially movable with respect to the single valve needle guide.

4. The fuel injector of claim 3, wherein at least one of the single valve needle guide and a swirl disk arranged downstream include orifices for passing fuel.

5. The fuel injector of claim 1, wherein a gap is formed between the needle collar of the valve needle and the collar of the sleeve-shaped needle driver, the gap widening in a radial direction toward a valve axis.

6. The fuel injector of claim 1, wherein the sleeve-shaped needle driver includes at least one orifice for passing fuel.

7. The fuel injector of claim 6, wherein the at least one orifice includes a bore in the sleeve-shaped needle driver.

8. The fuel injector of claim 6, wherein the at least one orifice includes a slit in the sleeve-shaped needle driver.

9. The fuel injector of claim 1, wherein the collar of the sleeve-shaped needle driver includes a bottom portion of the sleeve-shaped needle driver.

10. The fuel injector of claim 1, wherein the valve needle has a mass of between about 0.1 g and 0.5 g.

11. A fuel injector for a fuel injection system of an internal combustion engine, the fuel injector comprising:

an energizable actuator;

a valve needle having a needle collar;

a valve seating surface;

a return spring;

a valve closure element, the valve closure element being actuable by the energizable actuator via the valve needle and being cooperable with the valve seating surface to form a sealing fit, the valve closure element being holdable in a closed position by the return spring; and a sleeve-shaped needle driver, the sleeve-shaped needle driver being separate from the valve needle and having a collar, wherein the valve needle is arranged to move axially with respect to the sleeve-shaped needle driver;

wherein the energizable actuator acts on the valve needle via the sleeve-shaped needle driver, the collar of the sleeve-shaped needle driver is engageable behind the needle collar of the valve needle at an end facing away from the return spring, the sleeve-shaped needle driver includes at least one orifice for passing fuel, and the sleeve-shaped needle driver includes an opening with at least one radial enlargement at the collar overlapping an adjacent stop surface of the needle collar for forming at least one flow-through window.

12. A fuel injector for a fuel injection system of an internal combustion engine, the fuel injector comprising:

an energizable actuator;

a valve needle having a needle collar;

a valve seating surface;

a return spring;

a valve closure element, the valve closure element being actuable by the energizable actuator via the valve needle and being cooperable with the valve seating surface to form a sealing fit, the valve closure element being holdable in a closed position by the return spring; and a sleeve-shaped needle driver, the sleeve-shaped needle driver being separate from the valve needle and having a collar, wherein the valve needle is arranged to move axially with respect to the sleeve-shaped needle driver;

wherein the energizable actuator acts on the valve needle via the sleeve-shaped needle driver, the collar of the sleeve-shaped needle driver is engageable behind the needle collar of the valve needle at an end facing away from the return spring, the sleeve-shaped needle driver includes at least one orifice for passing fuel, the sleeve-shaped needle driver includes a circular opening at the collar, and the needle collar is polygonally configured so that a stop surface of the needle collar is partially overlapped by an opening of the needle driver for forming at least one flow-through window.

13. A fuel injector for a fuel injection system of an internal combustion engine, the fuel injector comprising:

an energizable actuator;

a valve needle having a needle collar;

a valve seating surface;

a return spring;

a valve closure element, the valve closure element being actuable by the energizable actuator via the valve needle and being cooperable with the valve seating surface to form a sealing fit, the valve closure element being holdable in a closed position by the return spring;

a sleeve-shaped needle driver, the sleeve-shaped needle driver being separate from the valve needle and having a collar, wherein the valve needle is arranged to move axially with respect to the sleeve-shaped needle driver; and an adjusting element;

wherein the energizable actuator acts on the valve needle via the sleeve-shaped needle driver, the collar of the sleeve-shaped needle driver is engageable behind the needle collar of the valve needle at an end facing away from the return spring, the sleeve-shaped needle driver includes at least one orifice for passing fuel, and the return spring is braced against the adjusting element at an end facing away from the needle collar, and the adjusting element is joined to the sleeve-shaped needle driver.

14. A fuel injector for a fuel injection system of an internal combustion engine, the fuel injector comprising:

an electromagnetic actuator having a solenoid coil and a magnetic armature that has an internal longitudinal opening;

a valve needle having a needle collar;

a valve seating surface;

a return spring;

a valve closure element, the valve closure element being actuable by the electromagnetic actuator via the valve needle and being cooperable with the valve seating surface to form a sealing fit, the valve closure element being holdable in a closed position by the return spring; and a sleeve-shaped needle driver, the sleeve-shaped needle driver being separate from the valve needle and having a collar, wherein the valve needle is arranged to move axially with respect to the sleeve-shaped needle driver, and the magnetic armature is coupled to the sleeve-shaped needle driver;

wherein the electromagnetic actuator acts on the valve needle via the sleeve-shaped needle driver, and the collar of the sleeve-shaped needle driver is engageable behind the needle collar of the valve needle at an end facing away from the return spring.

15. The fuel injector of claim 14, wherein the sleeve-shaped needle driver at least partially passes through the magnetic armature in an internal longitudinal opening.

16. The fuel injector of claim 14, further comprising a swirl disk arranged downstream.

17. The fuel injector of claim 16, further comprising a single valve needle guide, wherein the valve needle is guided by being axially movable with respect to the single valve needle guide.

18. The fuel injector of claim 17, wherein at least one of the single valve needle guide and the swirl disk include orifices for passing fuel.

19. The fuel injector of claim 17, wherein guiding of the valve needle results in homogeneous energy transfer by the valve needle at the sealing fit.

20. The fuel injector of claim 17, wherein guiding of the valve needle results in homogeneous wear in a region of the sealing fit.

* * * * *